US007275741B2

(12) United States Patent
Worley et al.

(10) Patent No.: US 7,275,741 B2
(45) Date of Patent: Oct. 2, 2007

(54) METHODS AND APPARATUS FOR TRANSPORTING SHEET MEDIA

(75) Inventors: A. Justine Worley, Murrieta, CA (US); Long C. Doan, San Diego, CA (US); Kevin Bokelman, San Diego, CA (US); Allan Donley, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 477 days.

(21) Appl. No.: 10/858,357

(22) Filed: Jun. 1, 2004

(65) Prior Publication Data

US 2005/0263954 A1 Dec. 1, 2005

(51) Int. Cl.
*B65H 3/06* (2006.01)

(52) U.S. Cl. ..... 271/117; 271/118; 271/121

(58) Field of Classification Search ..... 271/117, 271/118, 121

See application file for complete search history.

(56) References Cited

U.S. PATENT DOCUMENTS

| | | | | |
|---|---|---|---|---|
| 4,548,394 | A | 10/1985 | Runzi | |
| 4,721,297 | A | 1/1988 | Katayama | |
| 4,934,686 | A * | 6/1990 | Ono et al. | 271/117 |
| 4,990,011 | A | 2/1991 | Underwood et al. | |
| 5,016,866 | A | 5/1991 | Takahahi | |
| 5,118,090 | A | 6/1992 | Sonoda et al. | |
| 5,265,859 | A * | 11/1993 | Watson et al. | 271/109 |
| 5,594,486 | A | 1/1997 | Kiyohara | |
| 5,823,524 | A * | 10/1998 | Kawada | 271/124 |
| 5,927,703 | A * | 7/1999 | Endo | 271/10.03 |
| 6,299,156 | B1 * | 10/2001 | Kaneda et al. | 271/117 |
| 6,378,858 | B1 | 4/2002 | Suga | |
| 6,412,771 | B1 | 7/2002 | Hirata et al. | |
| 6,431,541 | B2 * | 8/2002 | Kuo et al. | 271/118 |
| 6,457,707 | B1 | 10/2002 | Hendrix et al. | |
| 6,497,405 | B2 * | 12/2002 | Yu et al. | 271/116 |
| 6,663,098 | B2 | 12/2003 | Teo et al. | |
| 2002/0096819 | A1 | 7/2002 | Fukasawa et al. | |
| 2004/0004322 | A1 | 1/2004 | Jang | |

FOREIGN PATENT DOCUMENTS

| | | | |
|---|---|---|---|
| JP | 2132027 | A2 | 5/1990 |
| JP | 5024722 | A2 | 2/1993 |

* cited by examiner

*Primary Examiner*—David H Bollinger

(57) ABSTRACT

A sheet handling assembly includes a frame, a first assembly, and a second assembly, each assembly rotatably supported by the frame and configured to contactingly transport sheet media. A member is configured to rotate the second assembly in response to rotation of the member in a first direction. The frame is configured to pivot in the first direction in response to rotating the member in the first direction, and pivot in a second direction, opposite the first direction, in response to rotating the member in the second direction.

19 Claims, 5 Drawing Sheets

METHODS AND APPARATUS FOR TRANSPORTING SHEET MEDIA

BACKGROUND

Numerous types of imaging apparatus that utilize sheet media are known. Examples of such imaging apparatus include flatbed scanners, photocopiers, printers, optical character recognition (OCR) devices, etc. Differing embodiments of such imaging apparatus often include sheet handling apparatus that draw sheets of media one at a time away from a stack, thereafter routing and transporting each sheet while various typical operations are performed thereon (e.g., optical scanning, printing and/or imaging, etc.).

Known sheet handling apparatus as described above vary greatly in their respective configurations and methods of operation. However, many of such devices are directed to reliably drawing a single sheet of media away from a stack or reservoir of plural sheet media as a substantial first step during normal, repetitive operation. Due to various complicating factors such as, for example, friction between adjacent media sheets, static electric attraction, humidity, etc., such sheet handling apparatus are generally complex in their overall design and elemental count in the interest of providing consistent, acceptable operation.

Therefore, it is desirable to provide relatively simple methods and apparatus for consistently drawing sheets of media one at a time away from a stack of plural sheet media.

DETAILED DESCRIPTION

In some embodiments, the present teachings provide methods and apparatus for picking one sheet of media from a stack of sheet media and then transporting that sheet of media on to other elements and/or sections of a sheet handling device. Typically, the example methods and apparatus described herein may be incorporated within an imaging apparatus such as a flatbed scanner, photocopier, printer, facsimile machine, etc.

Figure 1:
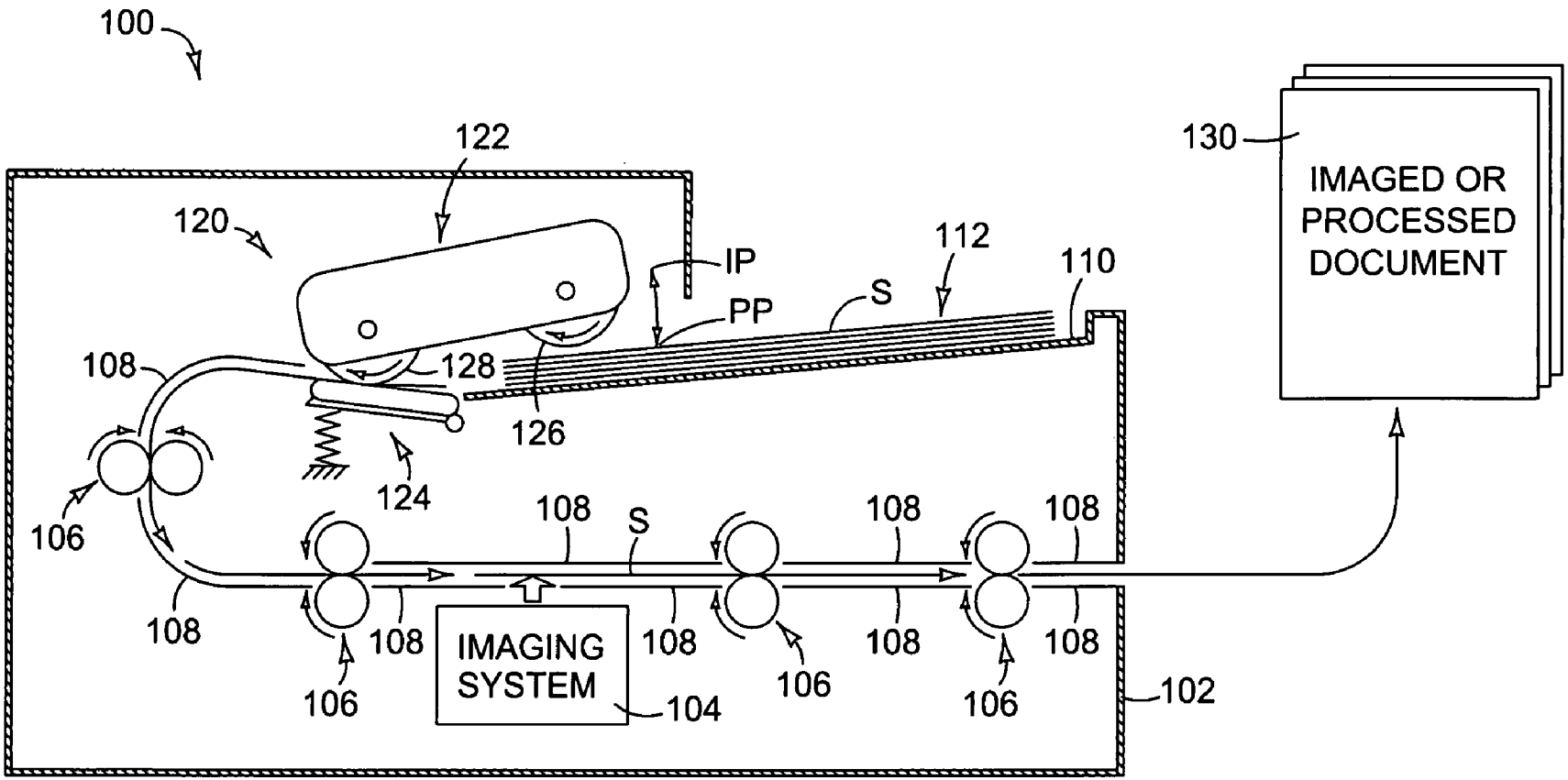
FIG. 1 is a side elevation sectional view depicting an imaging apparatus in accordance with one embodiment of the present invention.

Turning now to FIG. 1, a side elevation sectional view depicts an imaging apparatus 100 in accordance with one embodiment of the present invention. The imaging apparatus 100 includes a housing 102. The housing 102 is configured to generally surround and support any suitable number of elements and systems for operation of the imaging apparatus 100. The housing 102 can be formed from any suitable, substantially rigid material. Non-limiting examples of such a material include plastic, metal, etc. Other materials can also be used.

The imaging apparatus 100 also includes an imaging system 104. As depicted in FIG. 1, the imaging system 104 is assumed to be defined by an optical scanner configured to optically scan (i.e., read) images borne on sheet media "S" and convert the scanned images into digital electronic information. Other kinds of imaging system 104 can also be used. One of skill in the imaging arts can appreciate that the optical scanner assumed in FIG. 1 is exemplary of any number of other possible imaging systems 104 (e.g., photographic systems, laser or inkjet imaging devices, etc.) usable with the present invention. In any case, one or more sheets of media S are typically routed into cooperative orientation with the imaging system 104, one sheet at a time, and are then discharged from the imaging apparatus 100 to define an imaged or otherwise processed document 130.

The imaging apparatus 100 further includes a number of pairs of cooperative sheet media transporting rollers (hereinafter, roller pairs) 106, as well as a number of sheet guide plates 108. Each roller pair 106 is mechanically coupled to a media transporting drive motor (not shown) and is configured to define a sheet media transporting nip that selectively and progressively moves sheets of media S through the imaging apparatus 100 in accordance with motor-driven rotation of the roller pairs 106. Each guide plate 108 generally defines either a curved or substantially planar, smooth surface configured to contactingly route sheet media S through the imaging apparatus 100.

The imaging apparatus 100 further includes a sheet media support 110. As depicted in FIG. 1, the sheet media support 110 is generally defined by, and is a portion of, the housing 102. The sheet media support 110 is generally configured to support a plurality of sheet media S arranged as a stack 112. The precise configuration of the sheet media support 110 may vary and may comprise, for example, an input tray.

The imaging apparatus 100 also includes a sheet handling apparatus 120 in accordance with an embodiment of the present invention. The sheet handling apparatus 120 includes a sheet handling assembly 122. The sheet handling assembly 122 includes a prepick assembly 126 and a pick assembly 128. The sheet handling assembly 122 is configured to pivot from a generally upper or idle position "IP" to a generally lower or prepick position "PP" in which the prepick assembly 126 of the sheet handling assembly 122 is in transporting contact with the stack 112 of sheet media S supported by the sheet media support 110.

The prepick assembly 126 and the pick assembly 128 are rotationally driven by a motor (not shown) of the imaging apparatus 100. As described above, such a motor (not shown) is typically provided in order to supply motive power to other sheet media S transporting components of the imaging apparatus 100 such as, for example, the roller pairs 106. Furthermore, such a motor (not shown) is generally configured to provide selective bi-directional rotation in response to corresponding control signals (not shown).

The sheet handling apparatus 120 also includes a separator assembly 124. The separator assembly 124 is configured to contactingly cooperate with the pick assembly 128 such that only a single sheet of media S is passed there between during transporting of sheet media S onward toward the imaging system 104. Thus, the sheet handling assembly 122 and the separator assembly 124 are cooperatively configured and supported within the housing 102 of the imaging apparatus 100 so as to draw individual sheets of media S away from the stack 112, one at a time, in response to corresponding motor drive (not shown) during typical, repetitive operation of the sheet handling apparatus 120. Further elaboration of the structure and typical operation of the sheet handling apparatus 120 is provided hereinafter.

Figure 2:
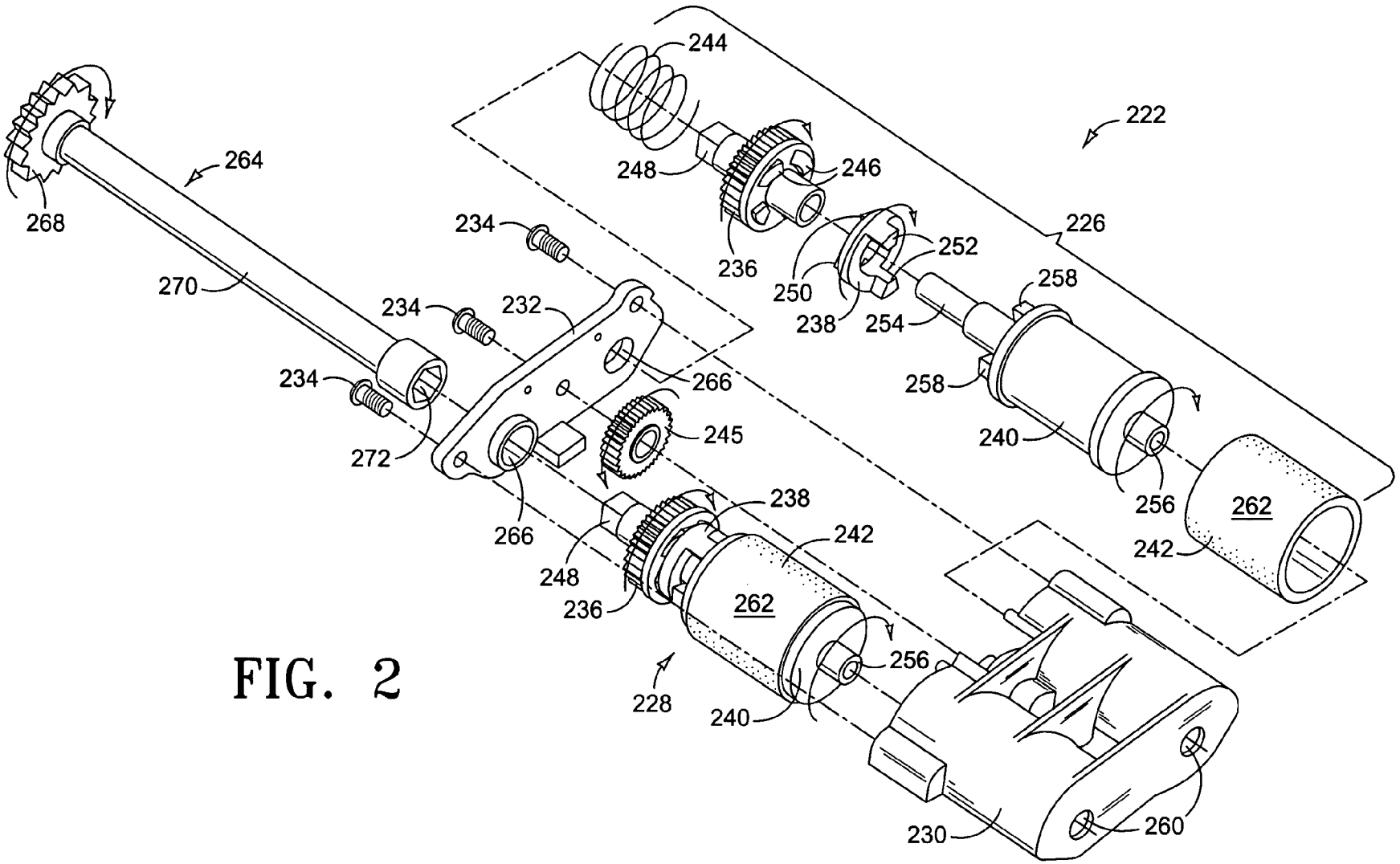
FIG. 2 is an exploded isometric view depicting a sheet handling assembly in accordance with another embodiment of the present invention.

FIG. 2 is an exploded isometric view depicting a sheet handling assembly 222 in accordance with another embodiment of the present invention. The sheet handling assembly 222 of FIG. 2 can be used, for example, to serve as the sheet handling assembly 122 of FIG. 1.

The sheet handling assembly 222 of FIG. 2 includes a sheet pick frame 230. The sheet pick frame 230 can be formed from any suitable, substantially rigid material such as, for example, plastic, nylon, metal, etc. Other suitable materials can also be used. The sheet pick frame 230 includes removable end piece 232 that is securable to the balance of the sheet pick frame 230 by way of plural threaded fasteners 234. The sheet pick frame 230 and the end piece 232 are cooperatively configured so as to rotatably support a plurality of other elements of the sheet handling assembly 222 as described hereinafter.

The sheet handling assembly 222 also includes an idler gear 245. The idler gear 245 can be formed from any suitable substantially rigid material such as, for example, plastic, nylon, metal, etc. Other materials can also be used. The idler gear 245 is configured to be rotatably supported by the sheet pick frame 230 by way of a corresponding threaded fastener 234. The idler gear 245 is configured to rotationally couple additional rotatable elements of the sheet handling assembly 222, as described hereinafter.

The sheet handling assembly 222 further includes a prepick assembly 226 and a pick assembly 228. Each of the prepick assembly 226 and the pick assembly 228 include the following elements: a pick gear 236, a clutch ring 238, a pick hub 240, and a pick tire 242. Each of these elements 236-242 will be described in detail hereinafter.

Each pick gear 236 can be formed from any suitable substantially rigid material such as, for example, plastic, nylon, etc. Other materials can also be used. Each of the pick gears 236 is configured to be mechanically engaged and cooperative with the idler gear 245 such that a rotational drive applied to either of the pick gears 236 is transferred to the other of the pick gears 236. Each of the pick gears 236 defines a number of ramp-like teeth 246, and a substantially hexagonal axial projection (hereinafter, hexagonal projection) 248, which are respectively described in further detail hereinafter. Each pick gear 236 is also configured to be received and rotatably supported within the sheet pick frame 230 by way of through-apertures 266 defined by the end piece 232.

Each clutch ring 238 can be formed from any suitable substantially rigid material, such as those described above in regard to the pick gears 236. Each clutch ring 238 defines a number of ramp-like surface features 250 configured to cooperate with the ramp-like teeth 246 of a corresponding pick gear 236. In this way, driven rotation of the pick gears 236 in a first direction (indicated by the rotational arrows shown in FIG. 2) results in rotational engagement between each pick gear 236 and the corresponding clutch ring 238. Conversely, driven rotation of the pick gears 236 in a second direction (opposite to the first direction) results in a generally slipping disengagement between each pick gear 236 and the corresponding clutch ring 238, such that the clutch rings assume a substantially non-rotating, idle condition. Each clutch ring 238 also defines a pair of drive teeth 252 that are described in further detail hereinafter. In any case, each clutch ring 238 is configured to be rotatably supported by a corresponding pick hub 240.

Each pick hub 240 can be formed from any of the suitable materials described above in regard to the pick gears 236 and the clutch rings 238. Each pick hub 240 defines a generally spool-like entity including an axial shaft 254 and an axial projection 256. The axial shaft 254 is configured to rotatably support a corresponding pick gear 236 and a clutch ring 238. Each pick hub 240 also defines a pair of hub teeth 258 configured to be rotationally engaged by the drive teeth 252 of the corresponding clutch ring 238. Thus, when each of the pick gears 236 is rotationally driven in the first direction (as indicated in FIG. 2), such rotational drive is transferred to the corresponding pick hub 240 by way of the associated clutch ring 238. Conversely, when each of the pick gears 236 is driven in the second direction (opposite to the first, indicated direction), the pick hubs 240 assume a substantially non-rotating, idle condition by virtue of the same idle condition of the associated clutch ring 238.

Furthermore, the drive teeth 252 of the clutch rings 238 and the hub teeth 258 of their associated pick hubs 240 are further respectively configured such that an initial rotation of the clutch rings 238 (by way of the respective pick gears 236) of about one hundred ten (i.e., 110) degrees in the first direction is required in order for each clutch ring 238 to rotatably engage the corresponding pick hub 240. Such an initial rotation, or lag, provides for a brief time delay prior to pick hub 240 rotation that can be used to coordinate the operation of other elements within an apparatus (e.g., the imaging apparatus 100, etc.) incorporating the sheet handling assembly 222. For example, the time delay defined by the initial rotation of each clutch ring 238 can be used to permit the positioning of a paper stop actuator and/or paper stop gate (not shown, respectively) for purposes of guiding and/or transporting sheet media S within an imaging apparatus 100. Other uses for the time delay defined by the initial rotation of the clutch rings 238 can also be employed. In can case, the axial projection 256 of each pick hub 240 is configured to be received and rotatably supported within a corresponding aperture 260 defined by the sheet pick frame 230.

Each of the pick tires 242 can be formed from any suitable, generally resilient material. In one embodiment, each of the pick tires 242 is formed from EPDM. Other suitable materials can also be used. Each pick tire 242 generally defines a cylindrical shell configured to be received over a corresponding pick hub 240. In this way, each pick tire 242 is supported in a substantially non-slip orientation with the associated pick hub 240 such that driven rotation of the pick hub 240 results in corresponding rotation of the pick tire 242 supported thereon. Furthermore, each pick tire 242 defines a substantially high-friction media contact surface (hereinafter, surface) 262 configured to transport sheet media (see the sheet media S of FIG. 1) by way of substantially non-slip contact therewith during driven rotation of the pick tire 242 in the first direction.

Each of the prepick assembly 226 and the pick assembly 228 include one each of the pick gear 236, the clutch ring 238, the pick hub 240, and the pick tire 242 as respectively described above. Thus, the prepick assembly 226 and the pick assembly 228 are substantially similar in their overall configurations and elemental constituencies. Furthermore, the prepick assembly 226 also includes a drag spring 244. The drag spring 244 can be formed from any suitable material such as, for example, steel. Other suitable materials can also be used. The drag spring 244 is configured to provide (i.e., exert) a predetermined rotation retarding force on the pick gear 236 of the prepick assembly 226.

In this way, the drag spring 244 serves to increase the relative amount of rotational torque that must be applied to the pick gears 236 of the prepick assembly 226 and the pick assembly 228 so as to result in rotational motion thereof. This relatively increased torque requirement further results in a pivotal motion of the sheet pick frame 230, and the prepick assembly 226 and the pick assembly 228 supported thereby, prior to general rotation of the respective pick gears 236 and their associated clutch rings 238, pick hubs 240 and pick tires 242. In one embodiment of the present invention, this pivotal motion of the sheet handling assembly 222 generally defines a pivotal arc or angle of about fifteen (i.e., 15) degrees. This pivotal motion of the overall sheet handling assembly 222 will be described in further detail hereinafter.

The sheet handling assembly 222 also includes a pick drive member 264. The pick drive member 264 can be formed from any suitable substantially rigid material such as plastic, nylon, metal, etc. Other suitable materials can also be used. The pick drive member 264 defines pickup gear 268, an extension shaft 270, and a hexagonal socket 272. While the extension shaft 270 of the pick drive member 264 depicted in FIG. 2 is relatively elongated in nature, it is to be understood that other embodiments (not shown) of the pick drive member 264 can also be used defining extension shafts 270 of respectively different lengths. In one embodiment (not shown), a pick drive member 264 is defined wherein the pickup gear 268 is substantially close-coupled to the hexagonal socket 272. One of skill in the mechanical arts can appreciate that particular dimensions of the pick drive member 264 can be varied as required for use in a corresponding embodiment of the sheet handling assembly 222.

The pickup gear 268 is configured to mechanically interface with a corresponding gear or motor drive (not shown, respectively) generally external to the sheet handling assembly 222 such that rotational energy can be conveyed to other elements (e.g., the pick gears 236, the clutch rings 238, etc.) of the sheet handling assembly 222. The extension shaft 270 directly conveys such rotational drive of the pickup gear 268 to the pick gear 236 of the of the pick assembly 228 by way of mechanically received coupling between the hexagonal socket 272 and the hexagonal projection 248. Other mechanical couplings may, of course, be employed. Typical operation of the sheet handling assembly 222 will be described in further detail hereinafter.

Figure 3:
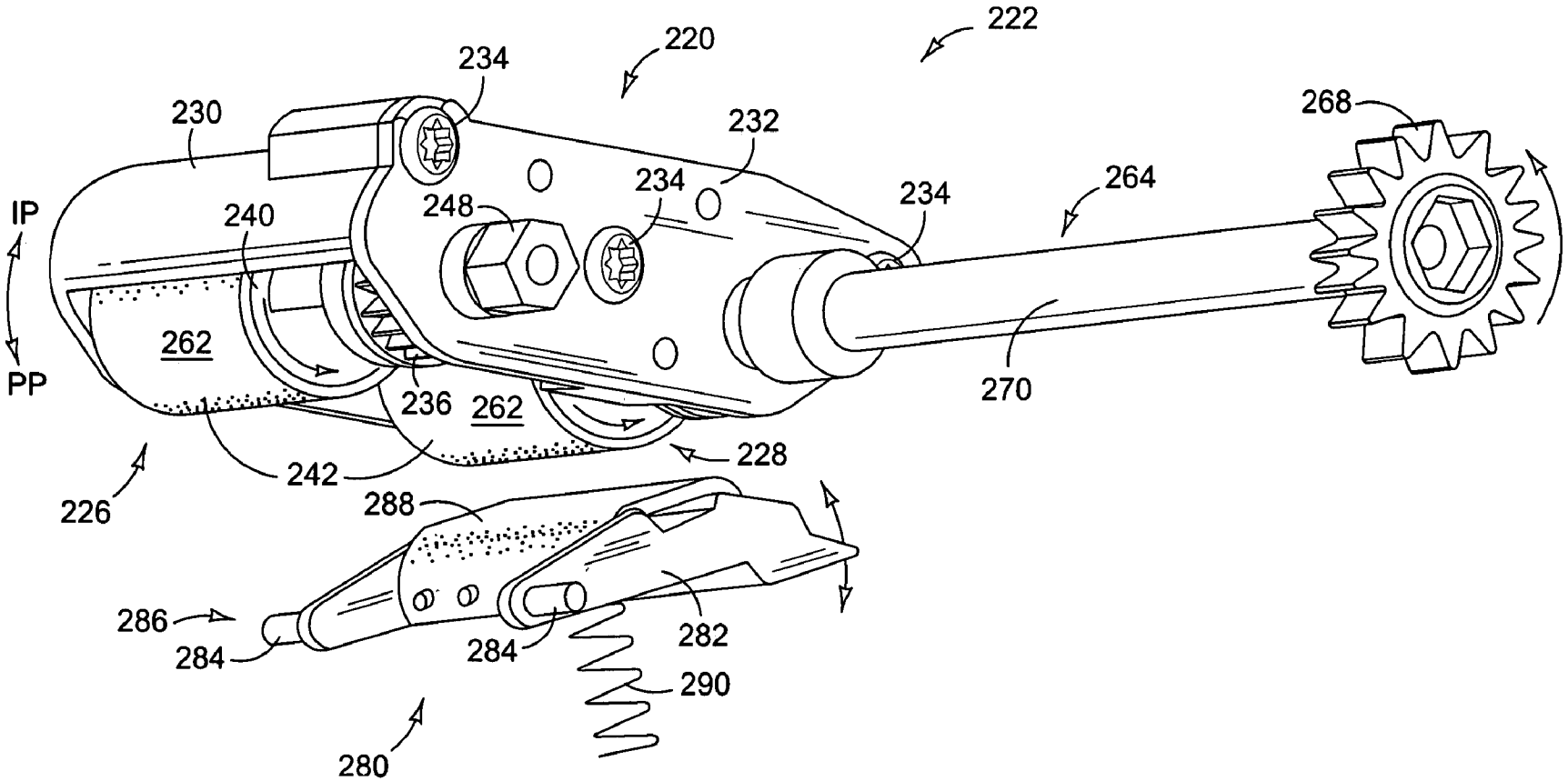
FIG. 3 is a front isometric view depicting a sheet handling apparatus in accordance with another embodiment of the present invention.

FIG. 3 is a front isometric view depicting a sheet handling apparatus 220 in accordance with another embodiment of the present invention. The sheet handling apparatus 220 of FIG. 2 can be used, for example, to serve as the sheet handling apparatus 120 of FIG. 1. The sheet handling apparatus 220 includes the sheet handling assembly 222 as described above in regard to FIG. 2. The sheet handling apparatus 220 further includes a separator assembly 280.

The separator assembly 280 includes a separator support 282. The separator support 282 can be formed from any suitable substantially rigid material such as, for example, plastic, nylon, metal, etc. The separator support 282 defines a pair of pivotal support posts 284 that are generally proximate to a first end 286 of the separator support 282. In this way, the separator support 282 is configured to be pivotably supported in cooperative orientation with the pick assembly 228 of the sheet handling assembly 222 by way of the pivotal support posts 284.

The separator assembly 280 also includes a separator pad 288. The separator pad 288 can be formed from any suitable material defining a substantially high surface friction. In one embodiment, the separator pad 288 is formed from an elastomer, such as rubber. Other materials can also be used to form the separator pad 288. The separator pad 288 is supported by the separator support 282 in a generally stretched yet relatively pliable condition. The separator pad 288 is configured to frictionally resist the sliding passage of one or more sheets of media (see the sheet media S of FIG. 1) that come into contact with the separator pad 288 during typical operation of the sheet handling apparatus 220. Also, the separator pad 288 is configured to be generally compliant in response to contact with the pick tire 242 of the pick assembly 228. Furthermore, the separator pad 288 is generally configured to define a surface friction that is less than the surface friction defined by the pick tire 242 of the pick assembly 228. In this way, the driven pick tire 242 of the pick assembly 228 can continue to rotate while in contact with the separator pad 288.

The separator assembly 280 further includes a support spring 290. The support spring 290 can be formed from any suitable material such as, for example, steel, etc. Other suitable materials can also be used. The support spring 290 is configured to exert a pivoting force on the separator support 282 toward the pick assembly 228, thus urging the separator pad 288 into cooperative contact with the pick tire 242 of the pick assembly 228. In this way, the pick tire 242 of the pick assembly 228 and the separator pad 288 define a kind of nip through which a single sheet of media (see the sheet media S of FIG. 1) is transported, or passed, while preventing the passage of one or more other sheets that may be contact with the separator pad 288, during typical operation of the sheet handling apparatus 220.

Also depicted in FIG. 3 are the generally upper or idle position IP, and the generally lower or prepick (i.e., operative) position PP, of the sheet handling assembly 222 as described above. Typical operation of the sheet handling apparatus 220 is described in further detail hereinafter.

Figure 4:
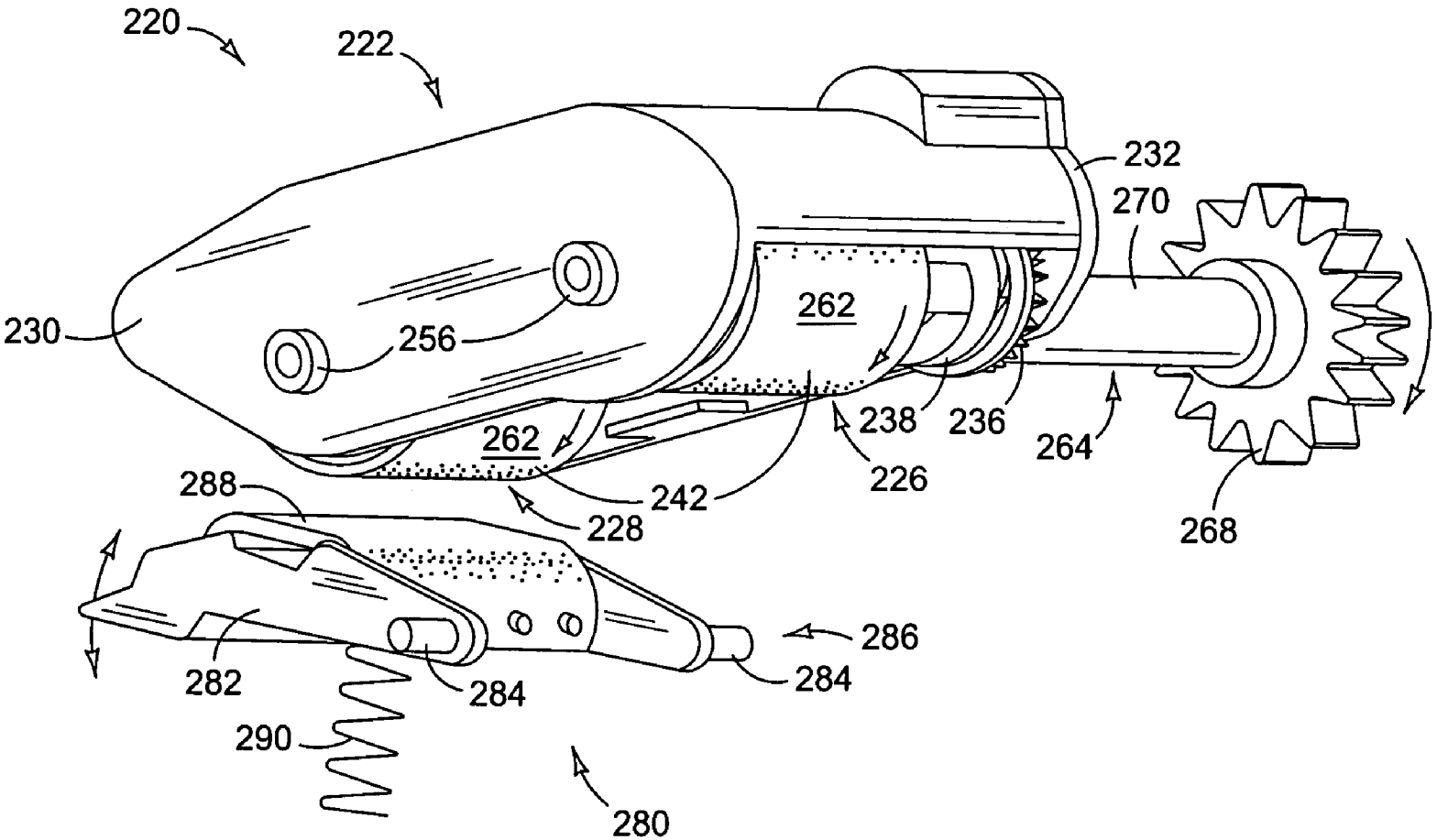
FIG. 4 is back isometric view depicting the sheet handling apparatus of FIG. 3.

FIG. 4 is a back isometric view depicting the sheet handling apparatus 220 as described above in regard to FIG. 3. FIG. 4 is provided in the interest of clear understanding of methods and apparatus of the present invention.

Figure 5:
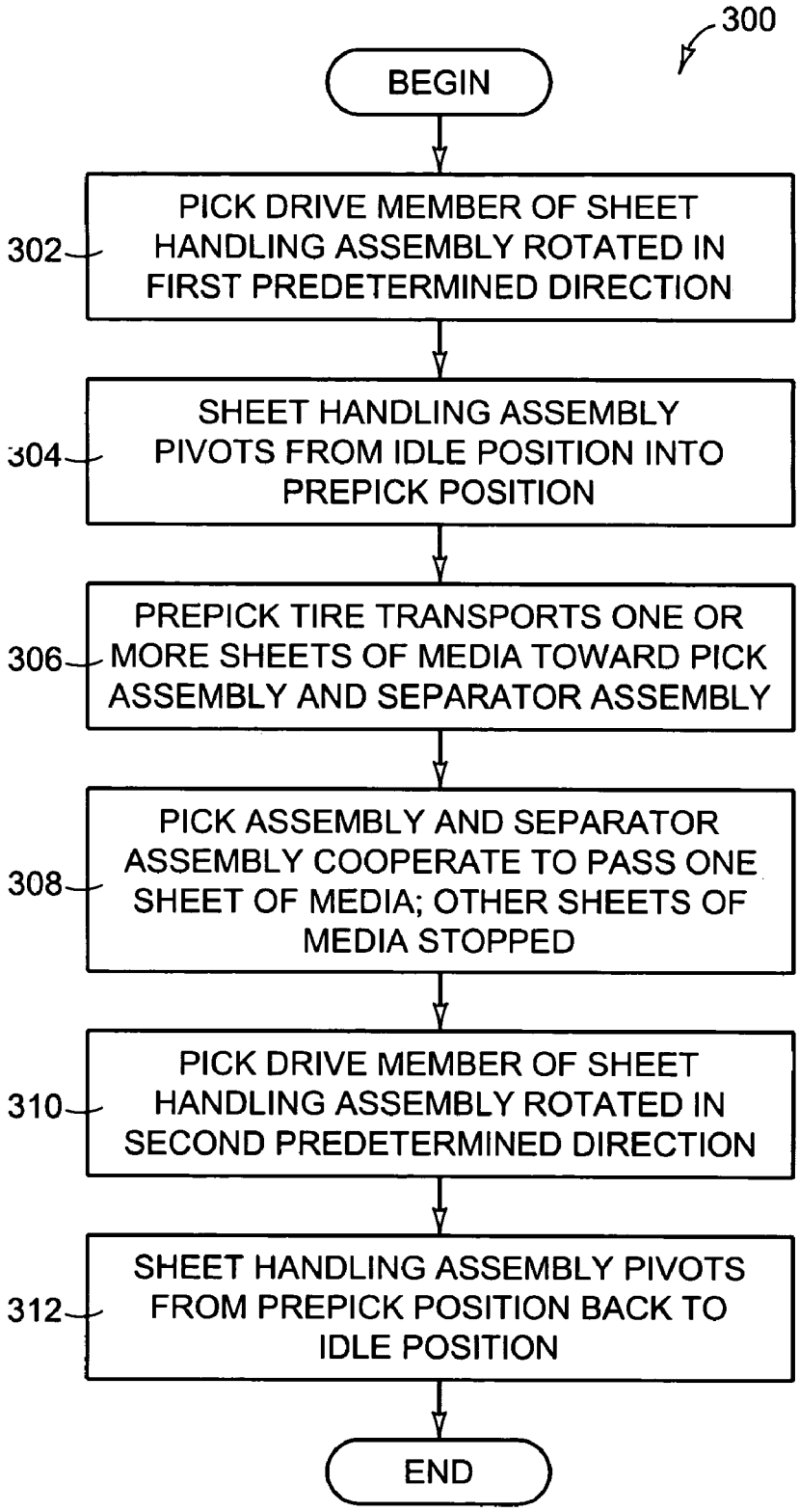
FIG. 5 is a flowchart depicting a method in accordance with a further embodiment of the present invention.

FIG. 5 is a flowchart 300 depicting a method in accordance with an embodiment of the present invention. While the method of the flowchart 300 describes particular steps and order of execution, it is to be understood that other methods including other steps and/or varying orders of execution can also be used in accordance with the present invention. In the interest of clarity of understanding, the method of the flowchart 300 of FIG. 5 is described in the context of FIGS. 1-3. To begin, it is assumed that a suitable imaging apparatus 100 is provided that incorporates the sheet handling apparatus 220 as described above in regard to FIGS. 2-4.

In step 302 (FIG. 5), the pick drive member 264 (FIG. 3) of the sheet handling assembly 222 is rotationally driven in a first predetermined direction as indicated in FIGS. 2-4. Such driven rotation is assumed to be provided to the pick drive member 264 by way of the controlled rotation of a motor (not shown) of the imaging apparatus 100 (FIG. 1).

In step 304 (FIG. 5), the sheet handling assembly 222 (FIG. 3) pivots generally about the pick drive member 264 from the idle position IP to the prepick position PP in response to the rotation of the pick drive member 264 in step 302 above. It is to be understood that generally little, or no, rotation of the pick gears 236 (FIG. 2) of the sheet handling assembly 222 occurs during this pivoting from the idle position IP (FIG. 3) to the prepick position PP, due at least in part to the rotation retarding force exerted by the drag spring 244 (FIG. 2) of the prepick assembly 226. Thus, the pick tire 242 of the prepick assembly 226 is brought into contacting position with a stack 112 (FIG. 1) of sheet media S.

In step 306 (FIG. 5), the continued rotation of the pick drive member 264 (FIG. 3) in the first direction results in a driven rotation of the pick tires 242 of the prepick assembly 226 and the pick assembly 228, respectively. As a result, one or more sheets of media S (FIG. 1) are drawn away from the stack 112 by way of contact with the rotating pick tire 242 (FIG. 3) of the prepick assembly 226 and transported toward the pick assembly 228 and the separator assembly 280.

In step 308 (FIG. 5), the rotating pick tire 242 (FIG. 3) of the pick assembly 228 passes one (i.e., an uppermost or top) sheet of media S (FIG. 1) onward between the pick assembly 228 (FIG. 3) and the separator pad 288. Contemporaneously, any one or more other sheets of media S (FIG. 1) are prevented from passing between the pick assembly 228 and the separator assembly 280 due to frictional contact between such one or more other sheets of media S and the separator pad 288 (FIG. 3). For purposes of example, it is assumed that the one passed sheet of media S (FIG. 1) is received by the various roller pairs 106 so as to be routed into cooperative orientation with an imaging system 104 of the imaging apparatus 100.

In step 310 (FIG. 5), the first-direction rotational drive that was previously applied to the pick drive member 264 (FIG. 3) during steps 302-308 (FIG. 5) above is now halted, and the pick drive member 264 (FIG. 3) is now rotationally driven in a second direction opposite to the first direction. As a result, the respective pick tires 242 of the prepick assembly 226 and the pick assembly 228 stop rotating by virtue of the rotationally idle condition assumed by the corresponding clutch rings 238 (FIG. 2) of the sheet handling assembly 222. At this point, the transporting of any sheet media S (FIG. 1) from the stack 112 of the imaging apparatus 100 has been halted.

In step 312 (FIG. 5), driven rotation of the pick drive member 264 (FIG. 3) in the second direction continues while the sheet handling assembly 222 pivots from the prepick position PP back to the idle position IP. Thereafter, any driven rotation of the pick drive member 264 is ended, and one operation of the sheet handling apparatus 220 is understood to be complete.

The method of the flowchart 300 of FIG. 5 described above depicts the usual operative steps required to transport a single sheet of media using the sheet handling apparatus 220. Typically, the steps 302-312 of the flowchart 300 are repeated as required, by way of substantially automated motor rotations (not shown), until any number of sheet media are drawn from a stack, one at a time, and routed onward to other portions of an imaging apparatus (e.g., the imaging apparatus 100 of FIG. 1) of the present invention.

While the above methods and apparatus have been described in language more or less specific as to structural and methodical features, it is to be understood, however, that they are not limited to the specific features shown and described, since the means herein disclosed comprise preferred forms of putting the invention into effect. The methods and apparatus are, therefore, claimed in any of their forms or modifications within the proper scope of the appended claims appropriately interpreted in accordance with the doctrine of equivalents.

We claim:

1. A sheet handling assembly comprising:

a frame;

a first assembly and a second assembly, each rotatably supported by the frame and configured to contactingly transport sheet media;

a member configured to rotate the second assembly in response to rotation of the member in a first direction, wherein the frame is configured to:

pivot in the first direction in response to rotating the member in the first direction; and pivot in a second direction, opposite the first direction, in response to rotating the member in the second direction; and at least one transmission member by which the first assembly and the second assembly are coupled for synchronous rotation, the at least one transmission member configured such that a predetermined initial angular rotation of the member in the first direction is reguired before causing rotation of the first assembly and the second assembly.

2. The apparatus of claim 1, wherein the frame is further configured such that the pivoting in the first direction and the pivoting in the second direction respectively define pivoting the frame through an angle of about 15 degrees.

3. The apparatus of claim 1, and further comprising a gear rotatably supported by the frame, the gear configured to rotate the first assembly in response to a rotation of the second assembly.

4. A sheet handling assembly comprising:

a frame;

a first assembly and a second assembly, each rotatably supported by the frame and configured to contactingly transport sheet media;

a gear rotatably supported by the frame, the pear configured to rotate the first assembly in response to a rotation of the second assembly; and a member configured to rotate the second assembly in response to rotation of the member in a first direction, wherein the frame is configured to:

pivot in the first direction in response to rotating the member in the first direction; and pivot in a second direction, opposite the first direction, in response to rotating the member in the second direction;

wherein each of the first assembly and the second assembly include:

a pick gear configured to mechanically cooperate with the gear;

a clutch configured to be rotationally driven in the first direction in response to a corresponding rotation of the pick gear, the clutch further configured to be rotationally idle in response to a rotation of the pick gear in the second direction;

a hub configured to be rotationally driven in the first direction in response to a corresponding rotation of the clutch, the hub further configured to be rotationally idle in response to a rotationally idle condition of the clutch; and a tire supported about the hub, the tire configured to contactingly transport sheet media in response to a rotation of the hub.

5. The apparatus of claim 4, wherein the first assembly further includes a spring configured to exert a predetermined rotation retarding force on the pick gear of the first assembly.

6. The apparatus of claim 4, wherein the pick gear and the clutch and the hub are respectively configured such that an initial rotation of the pick gear of about 110 degrees in the first direction is required to rotationally engage the clutch with the hub.

7. The apparatus of claim 4, wherein the pick gear and the clutch and the hub are respectively configured such that a predetermined initial angular rotation of the pick gear in the first direction is required to rotationally engage the clutch with the hub, and wherein the predetermined initial angular rotation defines a time delay.

8. The apparatus of claim 7, wherein the pick gear and the clutch and the hub are further respectively configured such that the time delay is used to coordinate an operation of a mechanism.

9. The apparatus of claim 7, wherein the pick gear and the clutch and the hub are further respectively configured such that the predetermined initial angular rotation of the pick gear is defined by about 110 degrees.

10. The apparatus of claim 4, wherein the tire is defined by a textured ring of EPDM.

11. The apparatus of claim 4, and further including a separator assembly, the separator assembly configured to cooperate with the sheet handling assembly so as to transport one sheet of media between the second assembly and the separator assembly during a rotation of the member in the first direction.

12. The apparatus of claim 11, wherein the separator assembly includes:

a support pivotally supported at a first end of the separator assembly;

a pad supported by the support, the pad configured to frictionally resist passage of at least one other sheet of media in contact with the pad, the pad further configured to be substantially compliant in response to forces exerted by the second assembly on the pad; and a spring configured to pivotally urge the separator assembly into cooperative contact with the second assembly.

13. The apparatus of claim 12, wherein the pad is formed from an elastomer.

14. The apparatus of claim 12, wherein the tire of the second assembly defines a coefficient of surface friction that is greater than a coefficient of surface friction defined by the pad.

15. An imaging apparatus, comprising:

an imaging section;

a media support configured to support sheet media; and a sheet handling assembly comprising:

a frame;

a first assembly and a second assembly, each rotatably supported by the frame and configured to contactingly transport the sheet media from the media support to the imaging section;

a member configured to rotate the second assembly in response to rotation of the member in a first direction, wherein the frame is configured to:

pivot in the first direction in response to rotating the member in the first direction; and pivot in a second direction, opposite the first direction, in response to rotating the member in the second direction; and at least one transmission member by which the first assembly and the second assembly are coupled for synchronous rotation, the at least one transmission member configured such that a predetermined initial angular rotation of the member in the first direction is required before causing rotation of the first assembly and the second assembly.

16. The imaging apparatus of claim 15, and further comprising a separator assembly configured to cooperate with the first assembly to pass one sheet of media between the first assembly and the separator assembly, the separator assembly including:

a separator support pivotally supported at a first end of the separator assembly;

a pad supported by the separator support, the pad configured to frictionally resist passage of at least one other sheet of media in contact with the pad, the pad further configured to be substantially compliant in response to forces exerted by the first assembly on the separator pad; and a spring configured to pivotally urge the separator support into contact with the first assembly.

17. The imaging apparatus of claim 16, wherein the first assembly defines a coefficient of surface friction that is greater than a coefficient of surface friction defined by the pad.

18. The imaging apparatus of claim 15, wherein the frame is further configured such that the pivoting in the first direction and the pivoting in the second direction respectively define pivoting the frame through an angle of about 15 degrees.

19. An apparatus, comprising:

prepick means for transporting first media toward a pick means;

pick means for advancing the first media;

separator means for preventing second media from passing the pick means; and means for bringing the prepick means into contact with the media in response to rotating the pick; and means for transmitting mechanical power to the prepick means and the pick means, the means for transmitting mechanical power configured such that a predetermined amount of movement of the means for transmitting mechanical power is reguired before mechanical power is applied to the prepick means and to the pick means.

* * * * *

UNITED STATES PATENT AND TRADEMARK OFFICE

CERTIFICATE OF CORRECTION

PATENT NO. : 7,275,741 B2
APPLICATION NO. : 10/858357
DATED : October 2, 2007
INVENTOR(S) : A. Justine Worley et al.

It is certified that error appears in the above-identified patent and that said Letters Patent is hereby corrected as shown below:

In column 8, line 14, in Claim 1, delete “reguired” and insert -- required --, therefor.

In column 8, line 24, in Claim 4, after “assembly” insert -- , --.

In column 8, line 29, in Claim 4, delete “pear” and insert -- gear --, therefor.

In column 10, line 44, in Claim 19, after “pick” insert -- means --.

In column 10, line 49, in Claim 19, delete “reguired” and insert -- required --, therefor.

Signed and Sealed this

Fifth Day of August, 2008

JON W. DUDAS
*Director of the United States Patent and Trademark Office*